US012716699B2

(12) United States Patent
Skalny et al.

(10) Patent No.: US 12,716,699 B2
(45) Date of Patent: Aug. 25, 2026

(54) TARGET STAND

(71) Applicant: Government of the United States, as represented by the Secretary of the Army, Washington, DC (US)

(72) Inventors: David Anthony Skalny, Shelby Township, MI (US); John Michael Zwally, Canton, MI (US); Byron Chan Wong, Sterling Heights, MI (US); Alexander William Hundich, Royal Oak, MI (US); Edward Thomas O'Connell, III, Lynn Township, MI (US)

(73) Assignee: GOVERNMENT OF THE UNITED STATES, AS REPRESENTED BY THE SECRETARY OF THE ARMY, Washington, DC (US)

( * ) Notice: Subject to any disclaimer, the term of this patent is extended or adjusted under 35 U.S.C. 154(b) by 963 days.

(21) Appl. No.: 17/532,145

(22) Filed: Nov. 22, 2021

(65) Prior Publication Data

US 2023/0160670 A1 May 25, 2023

(51) Int. Cl.
*F41J 7/00* (2006.01)

(52) U.S. Cl.
CPC ..... *F41J 7/00* (2013.01)

(58) Field of Classification Search
CPC . F41J 7/04; F41J 7/00; F41J 7/02; F41J 1/00; F41J 9/00; A63B 63/06
See application file for complete search history.

(56) References Cited

U.S. PATENT DOCUMENTS 650,008 A * 5/1900 Hamel ..... F41J 9/02 273/359
2,586,958 A * 2/1952 Roscoe ..... F41J 7/02 273/408

(Continued)

FOREIGN PATENT DOCUMENTS

FR 2830611 A1 * 4/2003 ..... F41J 9/02
GB 2304871 A * 3/1997 ..... F41J 9/02

(Continued)

OTHER PUBLICATIONS

ACG Conveyors: RBI Floor-to-Floor Incline Conveyor, Roller Bed; Retrieved from: http://acgconveyors.com/conveyors/wp-content/uploads/2014/11/11.5_c_rbi.pdf, last visited Apr. 27, 2021.

(Continued)

*Primary Examiner* — John E Simms, Jr.
*Assistant Examiner* — Amir A Klayman
(74) *Attorney, Agent, or Firm* — Daniel E. Hegner; Christopher H. Bond

(57) ABSTRACT

A target stand is described that may comprise a frame; first and second rails; and a trolley. The frame may support the first and second rails. The trolley may comprise a base, a first wheel assembly coupled to the base and in contact with the first rail, and a second wheel assembly coupled to the base and in contact with the second rail, wherein the trolley is movable between respective lower ends of the first and second rails and respective upper ends of the first and second rails via the first and second wheel assemblies contacting the first and second rails. The base of the trolley may comprise a proximal portion and a cantilevered portion extending away from the proximal portion to a free end, wherein the first and second wheel assemblies are coupled to the proximal portion and the cantilevered portion extends over the first and second rails.

15 Claims, 11 Drawing Sheets

(56) References Cited

U.S. PATENT DOCUMENTS 2,838,309 A * 6/1958 Merz ..... F41J 7/02 273/406
3,364,747 A * 1/1968 Ebstein ..... A63B 23/03525 482/97
3,620,530 A * 11/1971 Cosby ..... A63B 21/156 482/130
3,744,796 A * 7/1973 Renault ..... F41J 9/02 273/369
3,865,373 A * 2/1975 Knight ..... F41J 9/02 273/369
3,866,914 A * 2/1975 Jackson ..... A63B 21/0609 473/438
4,176,836 A * 12/1979 Coyle ..... A63B 21/068 482/96
4,346,886 A * 8/1982 Cox ..... A63B 69/06 482/51
4,535,985 A * 8/1985 Mask ..... A63B 21/4029 482/138
4,720,103 A * 1/1988 Palladino, Jr. ..... A63B 69/34 473/438
4,826,158 A * 5/1989 Fields, Jr. ..... A63B 23/0488 482/142
4,915,378 A * 4/1990 Abrahamian ..... A63B 23/0405 482/99
5,087,053 A * 2/1992 Head ..... F41J 9/02 273/408
5,169,363 A * 12/1992 Campanaro ..... A63B 21/0628 482/142
5,263,913 A * 11/1993 Boren ..... A63B 21/068 482/145
5,568,927 A * 10/1996 Badorrek ..... F41J 3/0004 273/366
5,827,154 A * 10/1998 Gill ..... A63B 21/0628 482/135
5,848,791 A * 12/1998 Beyer ..... F41J 9/02 273/359
5,868,396 A * 2/1999 Theissen ..... F41J 9/02 238/10 R
5,964,684 A * 10/1999 Sokol ..... A63B 21/4047 482/130
6,478,721 B1 * 11/2002 Hunter ..... A63B 23/0222 482/148
6,629,695 B2 * 10/2003 Tisdell ..... A63B 69/0068 273/359
6,786,847 B1 * 9/2004 Morgan ..... A63B 21/00076 482/142
7,037,244 B2 * 5/2006 Svihra ..... A63B 21/0626 482/93
7,520,843 B1 * 4/2009 Goddard ..... A63B 21/078 482/106
7,874,971 B2 * 1/2011 Reyes ..... A63B 21/4005 482/133
8,006,981 B2 * 8/2011 Gibson ..... F41J 9/02 273/359
D692,073 S * 10/2013 Nalley ..... D21/680
8,579,294 B2 * 11/2013 Wright ..... F41J 9/02 273/359
9,440,105 B1 * 9/2016 Lee ..... A63B 21/4034
9,470,040 B2 10/2016 Hall et al.
9,907,991 B2 * 3/2018 Leipheimer ..... A63B 21/0626
10,286,277 B1 * 5/2019 Zierke ..... A63B 1/00
12,070,652 B2 * 8/2024 Contessa ..... A63B 23/0405
2007/0293378 A1 * 12/2007 Webber ..... A63B 21/4047 482/97
2014/0371036 A1 * 12/2014 Ellis ..... A63B 22/001 482/66
2016/0107023 A1 * 4/2016 Campanaro ..... A63B 22/0076 482/72
2019/0070449 A1 * 3/2019 Naidus ..... A63B 23/0417
2020/0330820 A1 * 10/2020 Stearns ..... A63B 22/04
2021/0039245 A1 * 2/2021 Kukucka ..... B25H 3/003

FOREIGN PATENT DOCUMENTS

GB 2427257 A * 12/2006 ..... F41J 5/14
KR 101412602 B1 * 6/2014 ..... F41J 5/14

OTHER PUBLICATIONS

Lansmont Trumotion: TruMotion Acceleration Sled Details; Retrieved from http://www.lansmont.com/products/trumotion-acceleration, last visited Sep. 16, 2021.
Pinewood Derby Track Plans: Retrieved from https://docs.google.com/document/d/10T6Ozdf9xRbjBoBqgiGbJI_Q1eZQ6R7CBVvIRr913xw/edit, last visited Apr. 27, 2021.
Pinewood Derby Track: Retrieved from http://www.waynesthisandthat.com/pinewoodderbytrack, last visited Apr. 27, 2021.

* cited by examiner

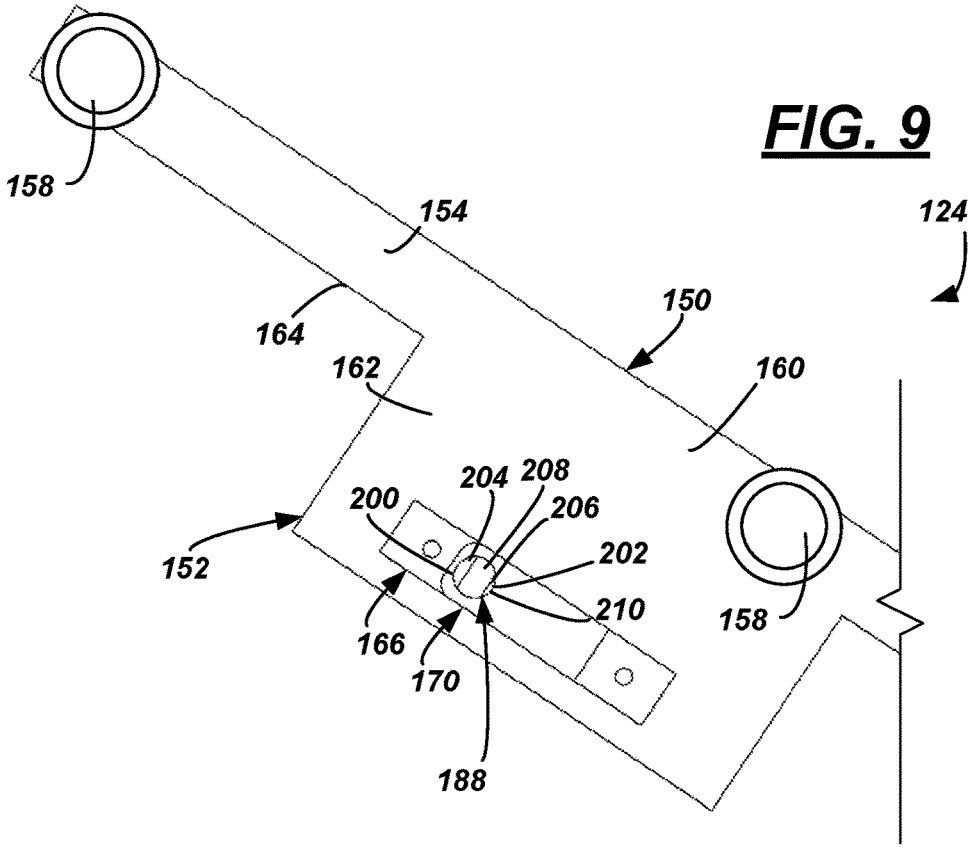
FIG. 9
FIG. 10
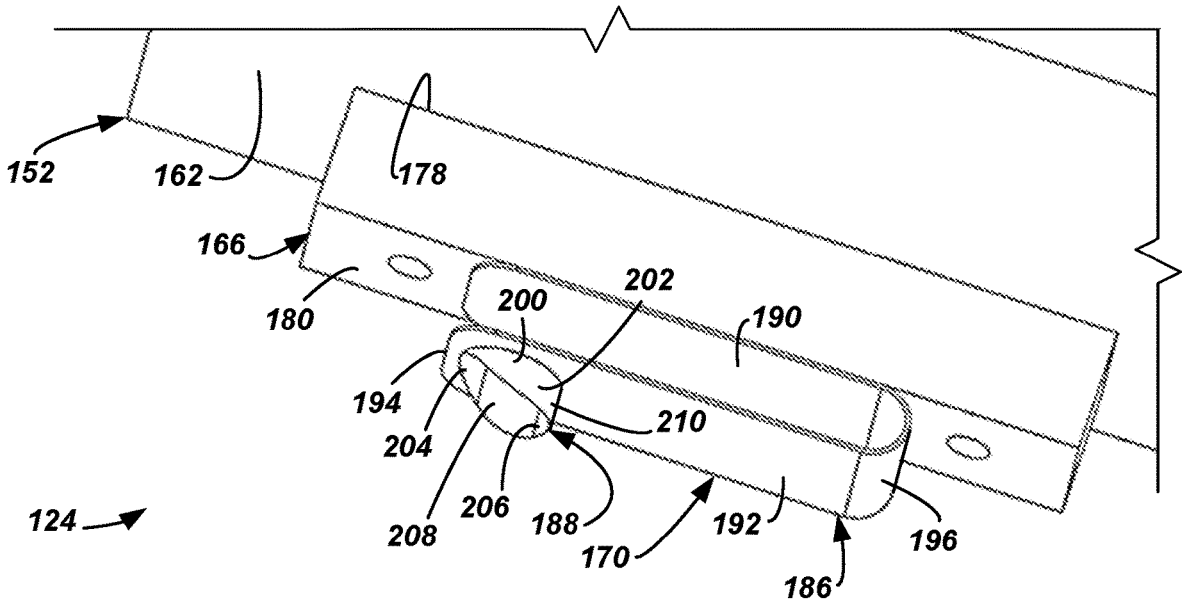

Top View

Front View

Right Side View

TARGET STAND

GOVERNMENT INTEREST

The invention(s) described herein may be manufactured, used, and/or licensed by or for the Government of the United States of America without payment by the Government of any royalties thereon.

TECHNICAL FIELD

The present disclosure pertains to a target stand, and more particularly to a target stand configured to move a target object under test.

BACKGROUND

Destructive testing may be used to measure or characterize the performance of an object under test. Typically, destructive testing is conducted in accordance with a test specification which defines time-consuming and sometimes difficult-to-execute test procedures. An example of destructive testing is when the object under test is subjected to projectile penetration. One example is a battery having a 6T form factor, as described in MIL-PRF-32565 (17 Nov. 2016), the entirety of which is incorporated herein by reference. Here, the battery is expected to not exceed SAE J2464 Hazard Severity Level 4 when the battery case is penetrated by three 7.62 mm armor piercing incendiary projectiles.

SUMMARY

According to one non-limiting embodiment of the disclosure, a target stand is described. The target stand may comprise a frame; a first rail; a second rail; and a trolley. The frame may support the first and second rails, wherein the first and second rails are inclined and each have an upper end and a lower end, wherein the first and second rails each extend relative to a y-axis and a z-axis, wherein the second rail is spaced from the first rail relative to an x-axis. The trolley may comprise a base, a first wheel assembly coupled to the base and in contact with the first rail, and a second wheel assembly coupled to the base and in contact with the second rail, wherein the trolley is movable between the respective lower ends of the first and second rails and the respective upper ends of the first and second rails via the first and second wheel assemblies contacting the first and second rails. The base of the trolley may comprise a proximal portion and a cantilevered portion extending away from the proximal portion to a free end, wherein the first and second wheel assemblies are coupled to the proximal portion and the cantilevered portion extends over the first and second rails.

BRIEF DESCRIPTION OF THE DRAWINGS

Figure

FIG. 9 is a partial side view of a wheel assembly of the trolley.

FIG. 10 is a partial perspective view a clip of the wheel assembly shown in FIG. 9.

DETAILED DESCRIPTION

Figure 1:
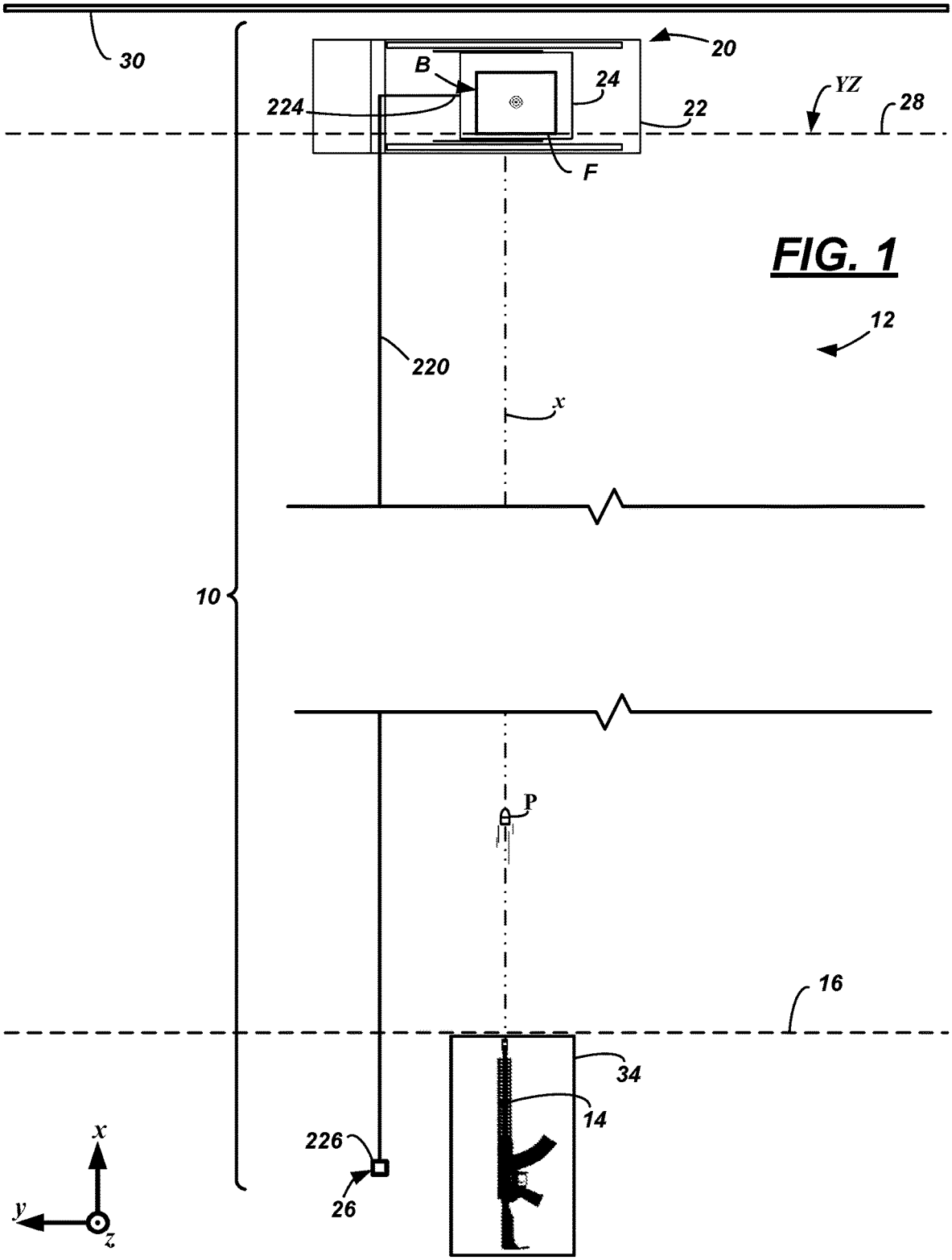
(FIG. 1 depicts an example schematic view of a test system comprising a firing range, a rifle at a firing line of the firing range, a non-limiting embodiment of a target stand which is located down-range of the rifle, and a target object under test ("target") carried by the target stand, wherein the target stand comprises a frame and a trolley.

Turning now to FIG. 1, wherein like elements denote similar features or functions, a test system 10 is disclosed. Test system 10 comprises a range 12 wherein a projectile source 14 (e.g., such as a rifle) is located at a firing line 16 and aimed (and fired) at a target object under test B (e.g., hereinafter, "target B") relative to a longitudinal axis x. Target B is carried by a non-limiting embodiment of a target stand 20. Target stand 20 may comprise a frame 22, a trolley 24 that is movable with respect to frame 22, and an actuator 26 that, when actuated, causes the trolley 24 to move relative to frame 22. Actuator 26 may be located at a position up-range of the target stand 20 (e.g., from a position near projectile source 14 (e.g., within a user's reach)). Target B may be secured to and carried by trolley 24, and trolley 24 may be supported by frame 22.

Figure 2:
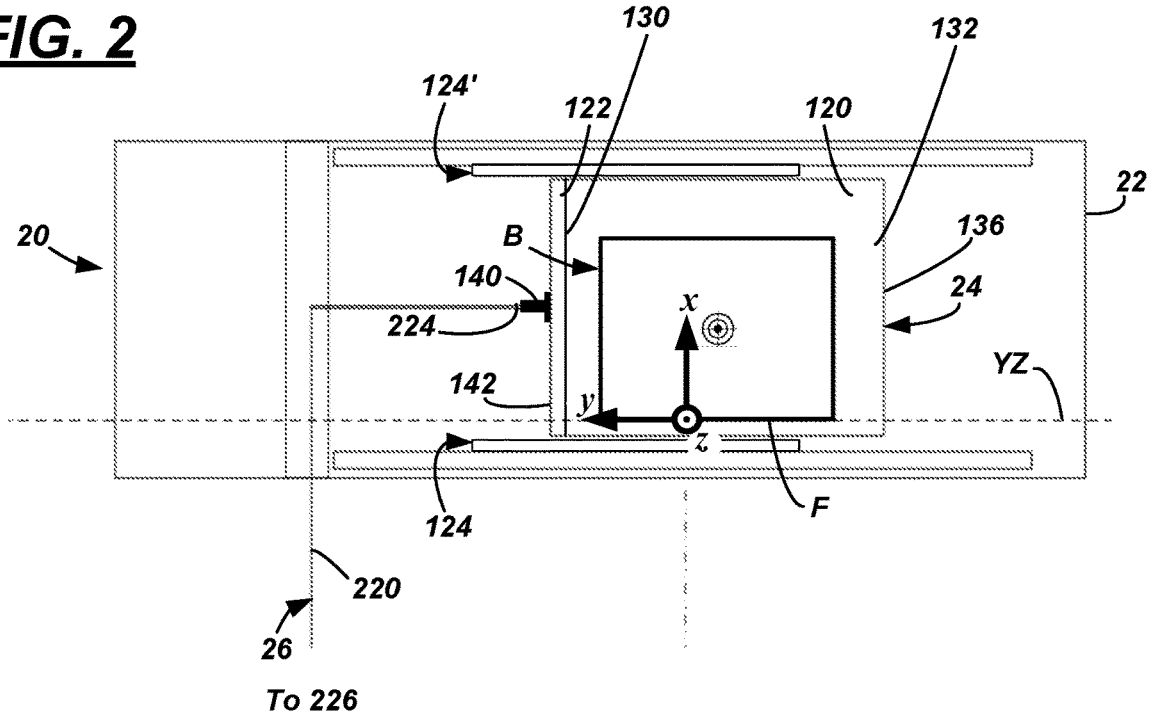
FIG. 2 is an enlarged view of a portion of FIG. 1 illustrating an example frame-of-reference relative to the target, frame, and trolley.
Figure 3:
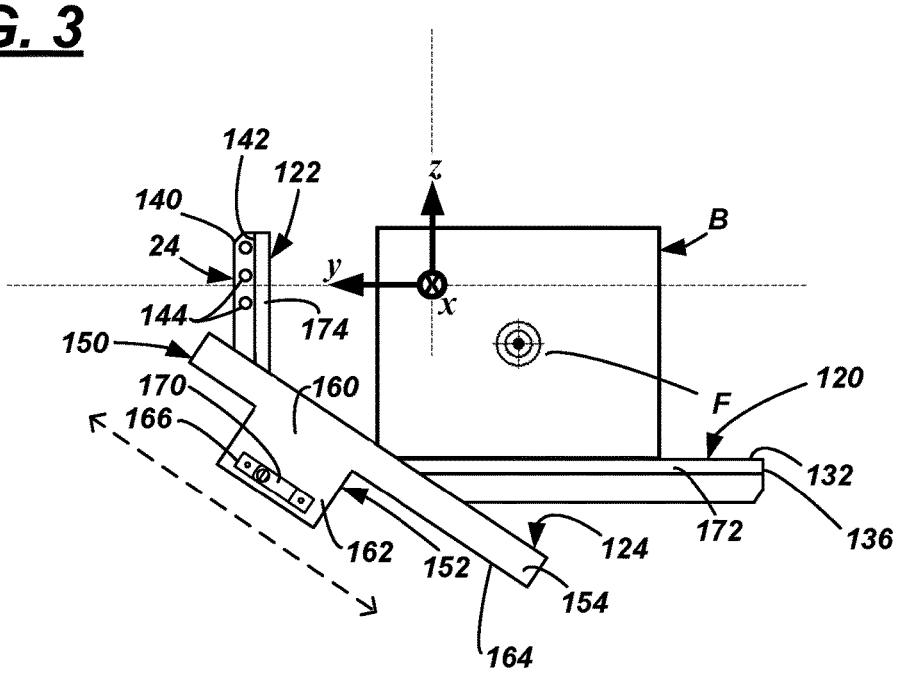
FIG. 3 is a front view of the trolley carrying the target, further illustrating the example frame-of-reference shown in FIG. 2 and the motion of the trolley (and target) relative to the frame-of-reference (some features of the trolley are hidden for clarity).
Figure 4:
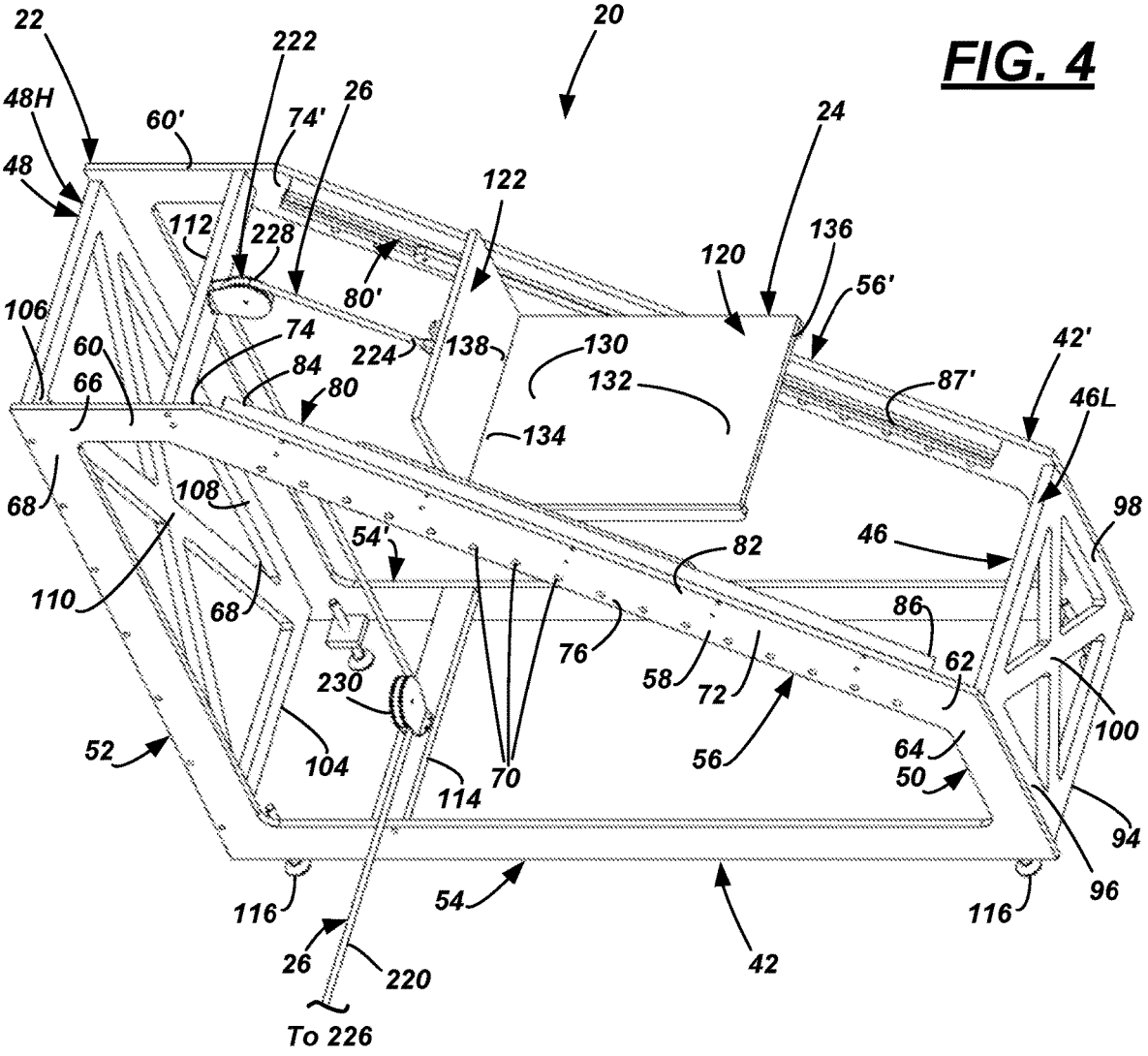
FIG. 4 is a perspective view of the target stand shown in FIG. 1.
Figure 5:
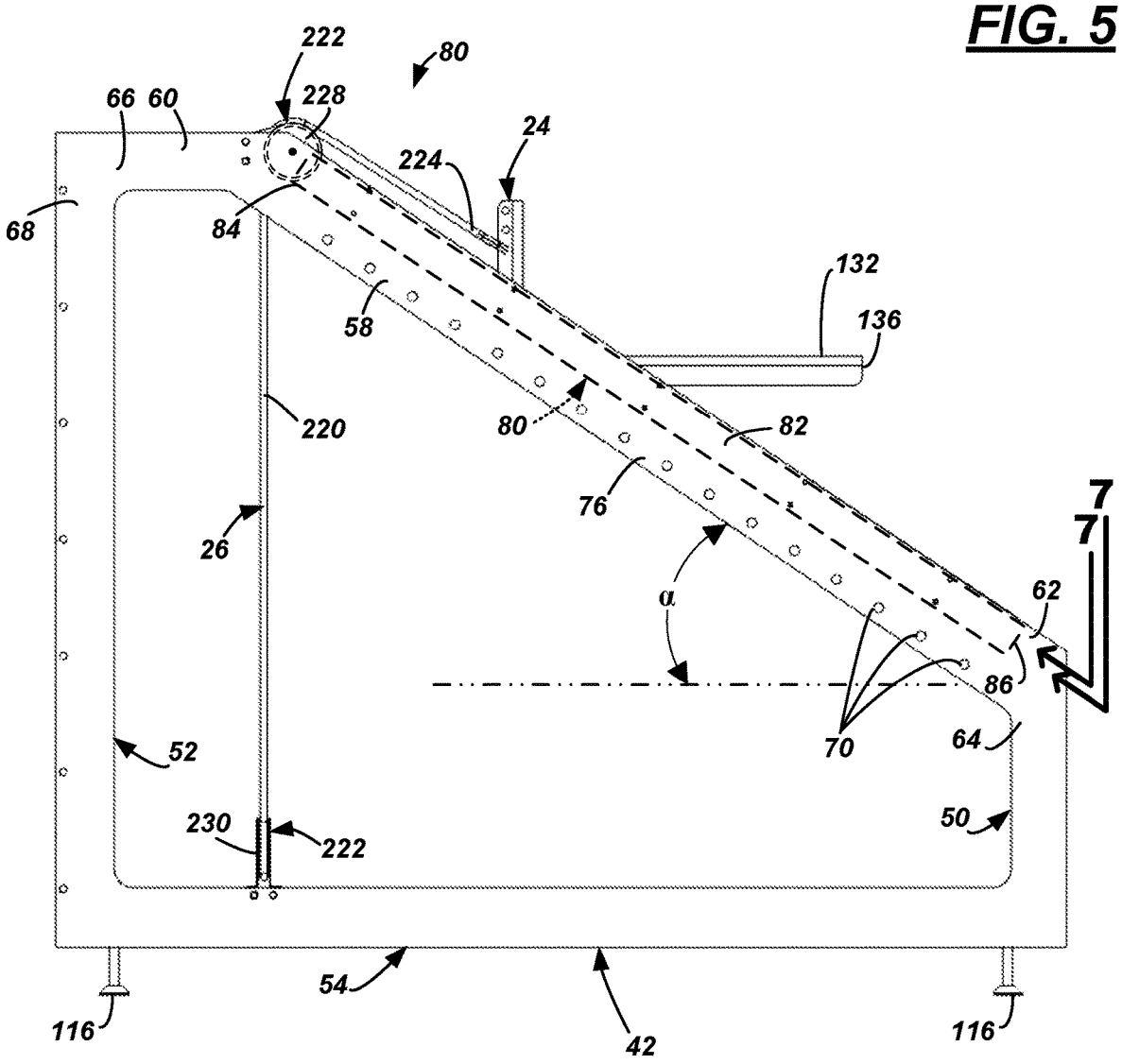
FIG. 5 is a front side view of the target stand shown in FIG. 1.
Figure 6:
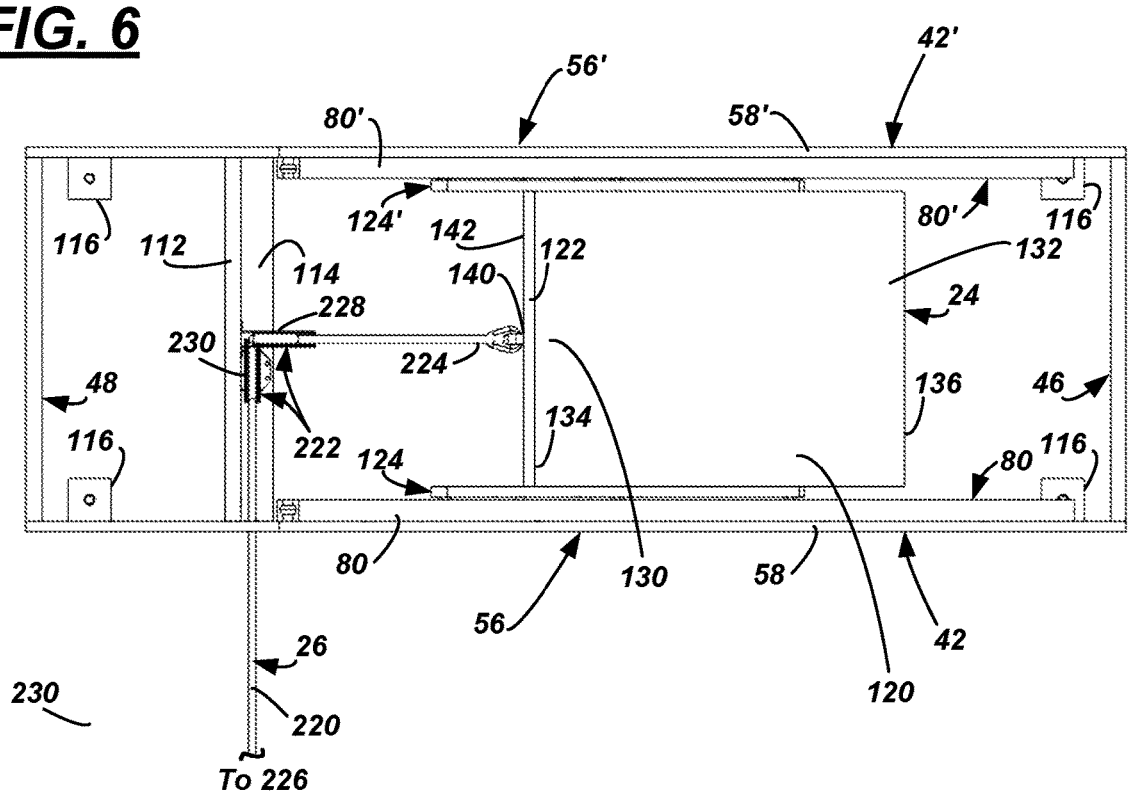
FIG. 6 is a top view of the target stand shown in FIG. 1.

By firing multiple projectiles P relative to axis x and by moving trolley 24, a front face F of target B may be impacted at several different points without moving the projectile source 14. As shown in FIGS. 1-3, front face F of the target B (and thus impact points due to fired projectiles P) may coincide with a plane-YZ (wherein plane-YZ is defined by a lateral axis y and a vertical axis z). FIG. 1 illustrates a target line 28 that also may be within plane-YZ.

Test system 10, and more particularly target stand 20, may facilitate testing in accordance with stringent projectile penetration requirements for objects such as target B. As described more below, target stand 20 may be used to fulfill requirements that define a relatively small impact region and/or projectile grouping such as those set forth in MIL-PRF-32565. For purposes of aiding a non-limiting explanation herein, test system 10 will be explained below with respect to testing a STANAG 4015 battery having a 6T form factor using 7.62 mm armor piercing incendiary (API) projectiles (fired from a 7.62 mm compatible weapon) wherein the 7.62 API projectiles impact front face F at an angle normal to the face F, as defined in MIL-PRF-32565. However, it will be appreciated that test system 10 may be used with different test objects under test, using different projectiles/projectile sources, at different angular orientations, etc. Thus, while a test system is described that facilitates military performance testing, test system 10 may be used for commercial and industrial testing as well (e.g., and in some circumstances, test system 10 may be applicable testing targets for police, private security, and/or other suitable entities).

The range 12 of test system 10 may be any suitable firing range. Range 12 is defined as a longitudinal region between the firing line 16 and an optional backstop 30 (or a sufficient longitudinal distance so that persons, objects, etc. are not disrupted by projectiles P). Thus, range 12 may include target line 28. Optional backstop 30 may include a hill of soil, a man-made structure for slowing projectiles, etc. Range 12 may be equipped with known safety systems (not shown) to promote safety of the users of the range. Additionally, range 12 may operate with predetermined protocols—e.g., regarding when operators are free to resume fire following a technician being down-range (e.g., anywhere between the firing line 16 and backstop 30). As explained below, execution of range protocols may be time-consuming during testing as delays may occur each time a technician enters the range 12, makes an adjustment to the target stand 20, and then exits the range. Range 12 may be suitable for large-caliber weapons, firing rifles, shotguns, handguns, other small arms, cross- and other bows, etc.

Projectile source 14 refers to any machine which propels projectiles P. Non-limiting examples include large-caliber weapons, rifles, shotguns, handguns, other small arms, cross- and other bows, and the like. Projectile source 14 may be supported by a stand or other suitable structure 34. Stand or other suitable structure 34 may permit a human user to fire the projectile source 14 without moving or disturbing the aim of source 14; alternatively, projectile source 14 may be fired by stand itself or by some other suitable mechanism (e.g., as in a weapon station). Some non-limiting examples of stand or other suitable structure 34 include a tripod stand, a pedestal stand, any suitable rest, recoil-reducing devices, or a combination thereof. In at least one example, projectile source 14 is 7.62 mm compatible weapon, projectiles P are 7.61 mm API, and the stand or other suitable structure 34 is a pedestal stand that positions the 7.62 mm compatible weapon so that its projectiles P strike front face F of target B normal to the front face F.

Turning to FIGS. 4-10, as described above, target stand 20 may comprise the frame 22, the trolley 24 which moves relative to the frame 22, and actuator 26 that controls movement of the trolley 24. Each will be discussed in turn.

Frame 22 may be any structure suitable for supporting trolley 24 and facilitating movement thereof. In at least one example, frame 22 comprise a front side portion 42, a rear side portion 42', an end bracket 46, and an end bracket 48. In at least one embodiment—but not required, front and rear side portions 42, 42' may be identical and may be oriented as mirror images of one another; therefore, only one will be explained in detail.

Front side portion 42 may comprise a first upright member 50, a second upright member 52, a lower strut 54 extending between and coupling corresponding lower portions of first upright member 50 and second upright member 52, and an inclined member 56 (extending between and coupling corresponding upper portions of first and second upright members 50, 52). In some embodiments (although not required), inclined member 56 may have a hockey stick shape comprising a body 58 and a flange 60 coupled to and extending from body 58, wherein an end portion 62 of body 58 may be coupled to an upper portion 64 of first upright member 50, wherein an end portion 66 of flange 60 may be coupled to an upper portion 68 of second upright member 52. In at least one example, front side portion 42 may be formed in a single, unitary piece; however, this is not required.

Inclined member 56 (more particularly, body 58) is shown oriented at angle $\alpha$ (FIG. 5); i.e., the angle of inclined member 56 relative to level ground. According to one embodiment, angle $\alpha$ is between 34° and 36°. According to another embodiment, angle $\alpha$ is between 30° and 40°. Still larger and different ranges may be used. In one embodiment, angle $\alpha$ of inclined member 56 corresponds to a testing procedure defined in MIL-PRF-32565 and the size of an impact region on the side of target B, as will be described in more detail below.

Inclined member 56 may comprise a plurality of holes 70 (e.g., through-holes) which may be spaced linearly along at least a portion of the length of inclined member 56. According to an example, these holes 70 may be extend from an outboard face 72 to an inboard face 74 along a lower region 76 of the inclined member 56. And in at least one embodiment, these holes 70 are aligned in a straight line. As will be discussed more below, these holes 70 may be used to move the trolley 24 a predetermined (and incremental) distance along the target stand 20. The spacing between any two holes 70 may vary; accordingly, the incremental distances may vary as well.

Target stand 20 further may comprise a pair of rails 80, 80' (e.g., a first rail and a second rail, respectively); rails 80, 80' may be spaced from one another relative to the x-axis. In at least one example, these rails 80, 80' may be identical and may be oriented as the mirror images of one another (e.g., rail 80 may be coupled to inclined member 56 and rail 80' may be coupled to inclined member 56'). Thus, only one will be described in detail.

Rail 80 may extend along inboard face 74 at an upper region 82 (of inclined member 56); it may be coupled to inclined member 56 via any suitable technique (e.g., fasteners, welding, etc.). Rail 80 may comprise an upper end 84 and a lower end 86 having an inclined orientation (extending relative to the y- and z-axes)—e.g., in at least one embodiment, rail 80 extends parallel to body 58. Other examples also exist; e.g., rail 80 may have an orientation according to any of the orientations of inclined member 56, as described above. Further, in at least one example, the orientation of rail 80 may differ from that of inclined member 56.

Figure 7:
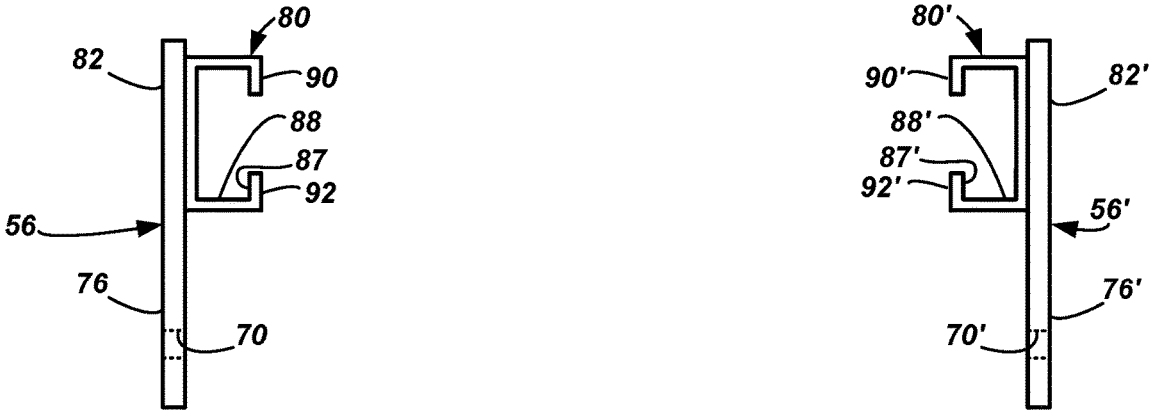
FIG. 7 is a partial sectional view along section lines 7-7 shown in FIG. 5, wherein the partial sectional view illustrates a portion of the frame and a pair of rails of the target stand, wherein other feature are hidden.

As best shown in FIG. 7, rail 80 may have a C-shaped cross-section defining a channel 87, a track 88 at the base of the channel 87, and captive upper and lower flanges 90, 92 (rail 80' is shown having a track 88' and corresponding flanges 90', 92'). Other cross-sections are possible as well; e.g., rail 80 may have any shape which can support trolley 24 (e.g., via the wheels, rollers, etc. thereof). In another embodiment, rails 80, 80' could be formed within the inclined members 56, 56' (e.g., integral thereto). In at least some embodiments, rail 80 is comprised of extruded aluminum or extruded plastic; however, other examples also exist.

Locating the rails 80, 80' on inboard faces 74, 74' of the rails 80, 80', respectively, offers some ballistic protection during live-fire testing; however, other embodiments of rails 80, 80' also may be used. E.g., rails 80, 80' could be mounted on an upper surface of each of the respective inclined members 56, 56' so that channels 87, 87' face upwardly instead of inwardly.

As discussed above, rear side portion 42' may comprise similar features. Each feature is designated using an apostrophe ('), and for sake of brevity, will not be re-described here.

End bracket 46 may comprise a rectangular border 94 which comprises, among other things, a side 96 and a side 98 (which is opposite side 96). Sides 96, 98 may be coupled to (and between) front and rear side portions 42, 42', respectively. In the illustrated embodiment, end bracket 46 also comprises a criss-cross brace 100 extending within and coupled to border 94; in other embodiments, a different brace may be used or no brace may be present.

End bracket 48 may be similar to end bracket 46, except it may be taller to accommodate the height of the target stand 20 on an opposite end; thus, frame 22 has a high end 48H (corresponding to end bracket 48) and a low end 46L (corresponding to end bracket 46), wherein the frame 22 slopes downwardly from high end 48H to low end 46L with respect to the y- and z-axes. For example, end bracket 48 may comprise a rectangular border 104 which comprises, among other things, a side 106 and a side 108 (which is opposite side 106). Sides 106, 108 may be coupled to (and between) front and rear side portions 42, 42', respectively. In the illustrated embodiment, end bracket 48 also comprises a criss-cross brace 110 extending within and coupled to border 104; in other embodiments, a different brace may be used or no brace may be present.

Frame 22 may comprise other features as well. E.g., in the illustrations, frame 22 includes a first stanchion 112 and a second stanchion 114. First stanchion 112 may extend between inclined members 56, 56' (and more particularly, between flanges 60, 60'). Second stanchion 114 may extend between lower strut 54 (of front side portion 42) and lower strut 54' (of rear side portion 42'). In the illustrated embodiment, first stanchion 112 is positioned directly above second stanchion 114; however, this is not required in all embodiments. In at least one embodiment, frame 22 further comprises adjustable feet 116. E.g., feet 116 may facilitate leveling frame 22 when the ground is uneven (see FIG. 5).

It should be appreciated that the figures illustrate an embodiment of frame 22 and that other embodiments could be employed that suitably support trolley 24 and movement of trolley 24, as described more below. Further, frame 22 may be comprise of any suitable material. E.g., frame 22 may be composed of metal or composite; non-limiting examples include aluminum, steel, high hard steel, or the like. Further, couplings of the elements of frame 22 may include any suitable fasteners (screws, bolts, etc.), weldments, etc.

According to an embodiment, trolley 24 may comprise a base 120, an actuator bracket 122 coupled to the base 120, a first wheel assembly 124, and a second wheel assembly 124', wherein the first and second wheel assemblies 124, 124' each may be coupled to base 120 and actuating bracket 122. Each will be discussed in turn.

Base 120 may be any suitable platform for carrying target B. In the illustrations, it is illustrated as rectangular plate (oriented with respect to (e.g., parallel to) the x- and y-axes) having a proximal portion 130 and a cantilevered portion 132, wherein the proximal portion 130 is nearer the first and second wheel assemblies 124, 124', wherein the cantilevered portion extends over the rails 80, 80'. As used herein, the base 120 comprising cantilevered portion 132 may refer to the base 120 being a rigid structural element and being supported at only one end (in this case supported only at the proximal portion 130 and not at the cantilevered portion 132). In at least one embodiment, an edge 134 of the proximal portion 130 is coupled to the actuator bracket 122, and a free end 136 in the cantilevered portion 132 is not coupled to anything. As will be clarified more in the description below, cantilevered portion 132 may be suitable for live fire testing as target B is positioned away from the remainder of the target stand 20 so as to minimize damage of the target stand 20 due to stray projectiles P. Base 120 may be sized to fit and move between the front and rear side portions 42, 42' of frame 22. In at least some examples, base 120 may be configured to be slightly larger than the intended target; however, this is not required. Other embodiments of base 120 are also contemplated. While not shown, base 120 may comprise additional straps, brackets, etc. to retain target B thereto during testing.

Actuator bracket 122 may comprise any suitable plate that extends away from base 120 and is used to move the trolley 24 on frame 22. In the illustrated embodiment, actuator bracket 122 extends upwardly and is oriented with respect to (e.g., parallel to) the x- and z-axes such that an edge 138 is coupled to edge 134. This is merely an example, and actuator bracket 122 may have different shapes or sizes in other embodiments.

In at least one example, actuator bracket 122 may comprise a T-bracket or other suitable bracket 140 on a side 142 (side 142 facing away from base 120). In the illustrations, bracket 140 comprises a feature 144 (e.g., holes) for coupling to actuator 26. In this manner, actuator 26 may pull the trolley 24, as explained more below.

First wheel assembly 124 and second wheel assembly 124' may be mirror images of one another; therefore, only one will be described in detail. That said, first and second wheel assemblies could differ from one another; an example of a wheel assembly follows. First wheel assembly 124 may comprise a wheel portion 150 and a stopper portion 152.

Figure 8:
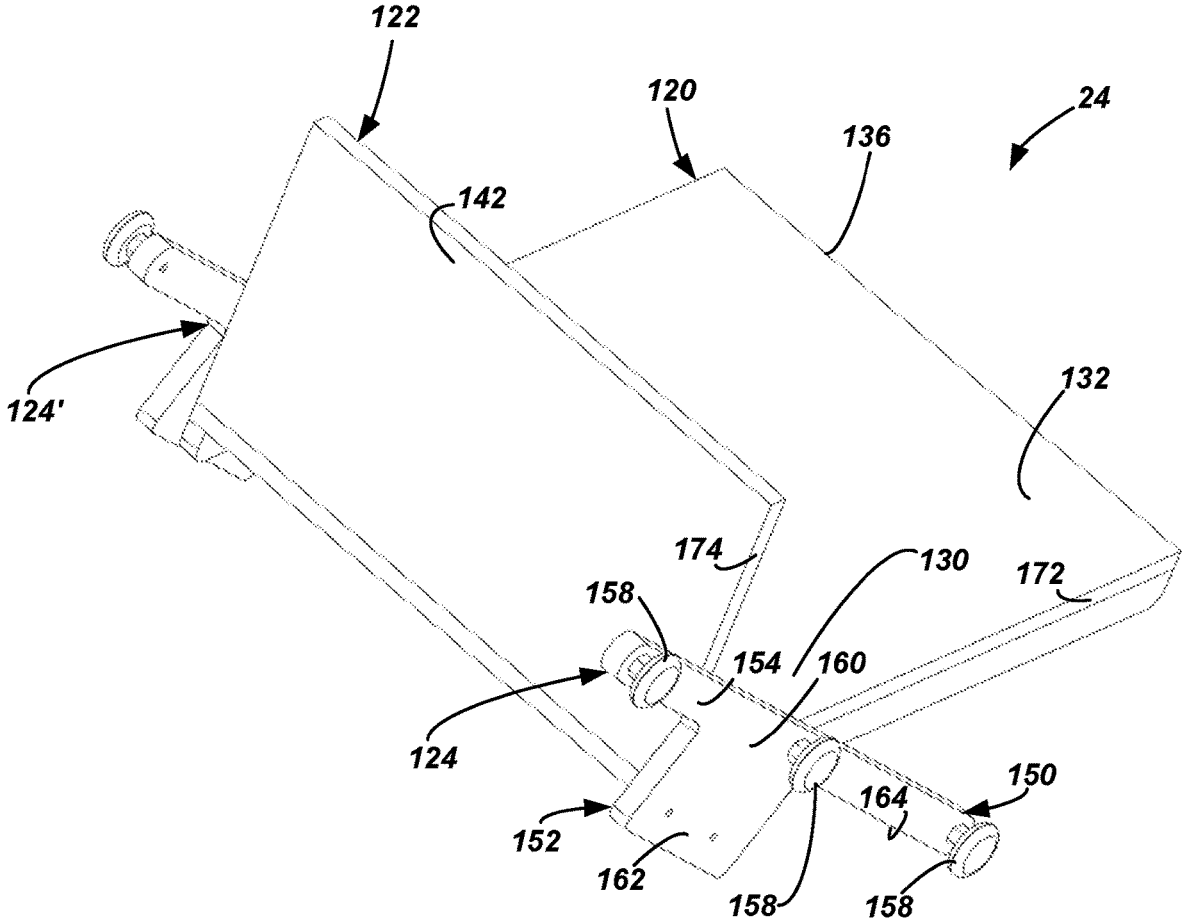
FIG. 8 is a perspective view of the trolley shown in FIG. 1, wherein some features are hidden from view.

Wheel portion 150 may comprise a carrier 154 which may comprise an elongated plate having axle holes (not shown) with a plurality of (or set of) wheels 158 carried via the axle holes (see FIG. 8; some elements (such as wheels) are hidden in FIG. 3, and some elements (e.g., T-bracket and clip) are hidden in FIG. 8). In one embodiment, wheels 158 are sized to move without interference within channel 87 of rail 80, to ride on track 88, and to stay within channel 87 being retained by flanges 90, 92. In at least one embodiment, the wheels 158 are in alignment with one another and each wheel 158 is positioned radially outwardly of an outboard side 160 of the carrier 154. Here, three wheels 158 are shown; however, more or fewer wheels may be used in other embodiments.

Stopper portion 152 may comprise a flange portion 162 extending from one side 164 (downwardly) of carrier 154, a spacer 166, and a clip 170. In some examples, carrier 154 and flange portion 162 may be formed in one unitary piece; however, this is not required. The carrier 154, the flange portion 162, or both may be coupled to outer edges 172, 174 of the base 120 and actuator bracket 122, respectively—giving the trolley 24 rigidity and a robustness for live-fire testing.

Spacer 166 may be any suitable protrusion that extends radially outwardly from outboard side 160 of flange portion 162. In the illustrated example, spacer 166 is a rectangular block having a first side 178 that abuts and is coupled to outboard side 160 and an opposite side 180 that abuts clip 170; however, other shapes may be used instead. The span between sides 178, 180 of spacer 166 may be sufficiently large so as to permit clip 170 to engage the holes 70 along inclined member 56 as the trolley 24 moves via actuator 26 and rails 80, 80'. In some embodiments of stopper portion 152, the spacer 166 and clip 170 are integrated into a single element; in other embodiments, the spacer 166 is not required.

According to an embodiment shown in the illustrations, clip 170 comprises a spring 186 and a unidirectional lock 188. In this example, spring 186 comprises a first leg 190 that is coupled to side 180 of spacer 166, a second leg 192 (shown in a nominal position) having a free end 194, and a U-shaped bend 196 coupled to first and second legs 190, 192 (one leg extending from each end of bend 196). When the free end 194 of the second leg 192 is displaced toward the first leg 190 (i.e., radially inwardly) (to a displaced position), U-shaped bend 196 is biased to cause the second leg 194 to return to the nominal position (biased radially outwardly). The free end 194 of second leg 192 may be oriented toward (and positioned closer to) actuator bracket 122 (and end bracket 48 of frame 22), whereas the U-shaped bend 196 may be oriented toward (and positioned closer to) free end 136 of trolley 24 (and accordingly, closer to end bracket 46 of frame 22). While not required in all embodiments, spring 186 may be oriented parallel to rail 80.

Lock 188 may comprise a ramped projection 200 coupled near free end 194 and extending radially outwardly from second leg 192. In at least one embodiment, ramped projection 200 has a circular periphery 202; however, this is not required. Ramped projection 200 may be sized to fit without interference into any of holes 70 of inclined member 56 (of frame 22)—e.g., as trolley 24 moves between inclined members 56, 56'. More particularly, lock 188 may comprise a low edge 204 and a high edge 206 and a radially-outwardly facing surface 208 that gradually slopes from low edge 204 to high edge 206. Low edge 204 may be nearer free end 194, and high edge 206 may be nearer the U-shaped bend 196. Based on this orientation (and as described more below), trolley 24 may be moved (by actuator 26) toward upper ends 84, 84' of rails 80, 80'—and as the trolley 24 is moved in this direction, free end 194 of second leg 192 of spring 186 may bend radially inwardly as lock 188 contacts the inboard face 74 of inclined member 56 (i.e., between the holes 70) and lock 188 may enter holes 70 as the trolley 24 moves into a corresponding position, wherein a radially extending side 210 of periphery 202 may inhibit trolley 24 from moving toward lower ends 86, 86' of rails 80, 80', respectively—e.g., when actuator is OFF or inactive.

The illustrated arrangement is merely an example. Other suitable springs and locks may be used instead. Spring 186 may be any suitable mechanism including but not limited to a compression springs, torsion springs, clock springs, various flat-form springs, various wire-form springs, and the like, just to name a few examples. Similarly, lock 188 may be any device that engages the inclined member 56 to cause the trolley 24 to brake and/or be retained in a desired position. Hence, non-limiting examples of lock 188 may comprise other protrusions, calipers, etc. Lock 188 and spring 186 may be integrated in a single piece or may be two elements that are coupled to one another.

According to at least one embodiment, only one of the first or second wheel assemblies 124, 124' comprise stopper portion 152. According to another embodiment, both of the first and second wheel assemblies 124, 124' comprise stopper portion 152.

Turning now to the actuator of target stand 20, according to one embodiment of actuator 26, actuator 26 may comprise a cable 220 and a cable feed system 222 (see FIGS. 1-6). Cable 220 may be any suitable rope, metal braided line, etc. that is suitably strong to move the trolley 24 along rails 80, 80', suitably flexible to weave within cable feed system 222, and suitably long to extend from a first end 224 (coupled to feature 144 of bracket 140) to a second end 226 that is located up-range near firing line 16 (e.g., on the user side of the firing line 16, at or near projectile source 14). According to at least one embodiment, cable 220 is comprised of braided steel cable or synthetic rope.

Cable feed system 222 may comprise any suitable elements to physically route the cable 220—while also permitting cable translation (in either direction) and cable turns (e.g., at a corner or bend). In the illustrated example (see FIGS. 4-6), cable feed system 222 comprises an upper pulley 228 and a lower pulley 230; however, this of course is merely an example. Upper pulley 228 may be coupled to first stanchion 112 and may be oriented towards end brackets 46, 48. Cable 220 may extend from bracket 140 (of actuator bracket 122) toward and onto upper pulley 228 and thereafter extend from upper pulley 228 downwardly toward and onto lower pulley 230. Lower pulley 230 may be coupled to second stanchion 114 and may be oriented towards front and rear side portions 42, 42'. Thus, cable 220 may extend away from lower pulley 230 toward front side portion 42 and continue towards firing line 16—ultimately terminating near the user and projectile source 14. In this manner, cable 220 may be manually pulled by the user, and in response, the trolley 24 may move upwardly until the lock 188 detents into a desired hole 70.

Trolley 24 may be comprised of any suitable metal or composite material. Actuator bracket 122 may be fastened or welded to base 120. Similarly, wheel assemblies 124, 124' may be fastened or welded to actuator bracket 122 and/or base 120. Wheels 158 of trolley 24 may be located within rails 80, 80'; thereafter, rails 80, 80' may be assembled to frame 22. Once frame 22 and trolley 24 are assembled, cable feed system 222 may be coupled to frame and trolley, and thereafter, cable 220 may be routed as previously described.

As disclosed above, when the actuator 26 is actuated, the trolley 24 may be moved incrementally in at least one direction. According to the embodiment previously described, trolley 24 may move upwardly (e.g., toward upper pulley 228). Lock 188 (and a corresponding unidirectional lock on wheel assembly 124' (not shown)) may detent through a number of holes 70 of inclined members 56, 56'. In this manner, if the target (located on base 120) is aligned with a firing path of projection source 14, trolley 24 may be inhibited from moving downwardly. Further, a predetermined sequence of trolley positions may be achieved by moving trolley 24 until the locks 188 are positioned in the desired holes 70.

Other target stand examples also exist. According to an example, inclined members 56, 56' may have at least some curvature. E.g., the previously described inclined members (and rails) were illustrated as straight; however, this is not required in all examples.

In at least one embodiment, target stand 20 is equipped with an electrical harness that is secured to the frame 22 at a first point and to trolley 24 at a second point in such a manner that the electrical harness dangles sufficiently between the first and second points to permit movement of trolley 24 from an upper end of inclined members 56, 56' to a lower end thereof—and it such a manner that the electrical harness does not create interference of such movement. In this manner, when target B is a battery, the battery may be connected to a resistive load (not on the trolley 24) during live fire testing. In other embodiments, the resistive load is carried by the trolley 24 as well (and no harness-routing on frame 22 is required).

Figure 11:
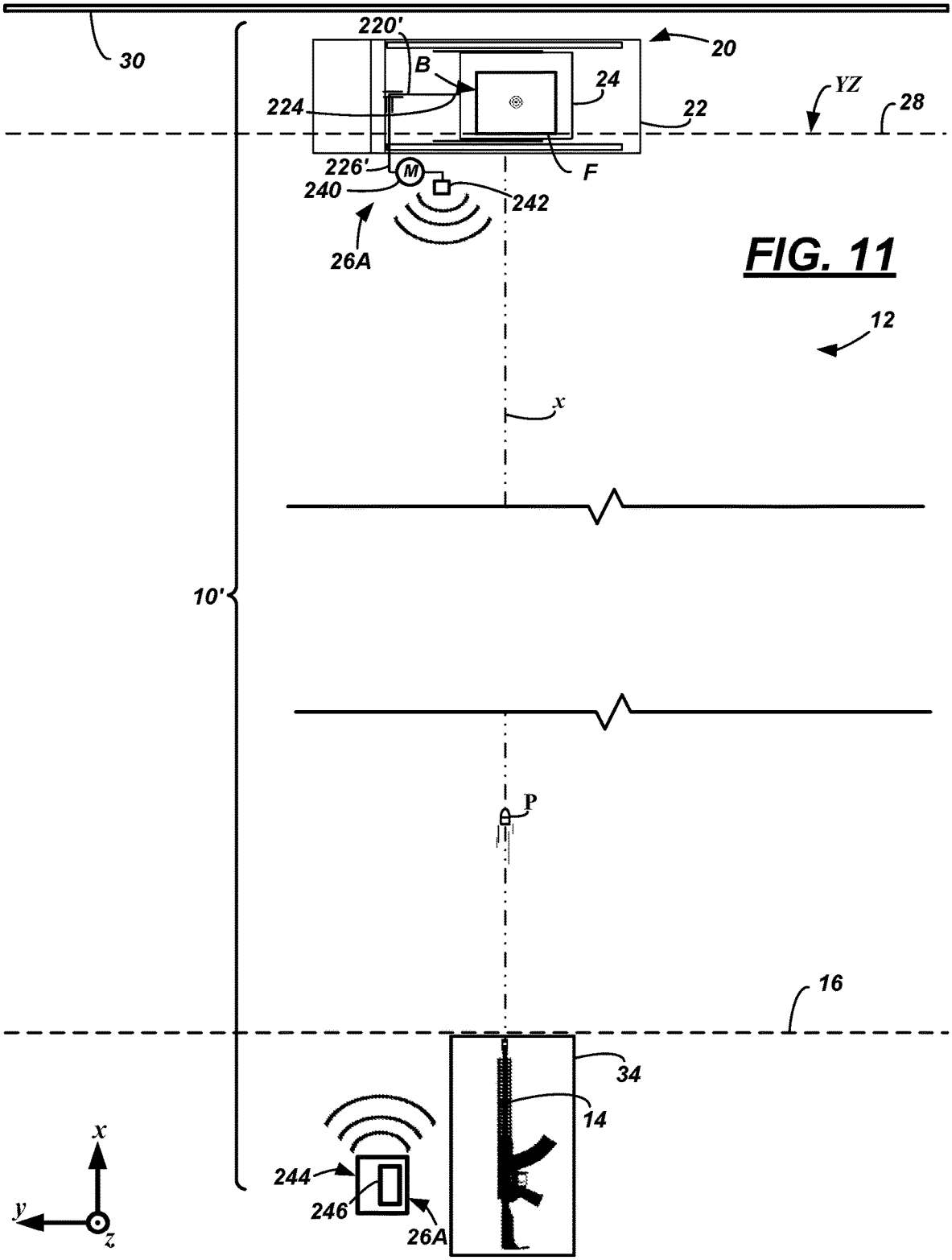
FIG. 11 illustrates a schematic view of another embodiment of a test system at the range facilitating electrical communication to move the trolley of the target stand.

Still other embodiments exist. For example, FIG. 11 illustrates a test system 10' that comprises an actuator 26A that is partially automated. Here, actuator 26A additionally comprises a motor 240 coupled a second end 226' of a cable 220' (cable 220' does not extend up-range), a down-range communication device 242 (near or mounted to frame 22) electrically coupled to motor 240, and an up-range communication device 244 (near user behind firing line 16). In operation, a user operates an interface 246 on device 244 to communicate wirelessly with device 242 (e.g., via Wi-Fi, Wi-Fi Direct, Bluetooth, cellular, etc.). In response to such a communication, down-range communication device 242 sends a signal to motor 240 which in turn actuates the winding of the cable 220' a predetermined amount—thereby moving the trolley 24 upwardly a predetermined distance. In this arrangement, holes 70 (on inclined members 56, 56') and stopper portion 152 may not be needed; in fact, in this embodiment, the trolley 24 could be raised (e.g., translated along rails 80, 80' toward the end bracket 48) or lowered (e.g., translated along rails 80, 80' toward the end bracket 46) a predetermined amount.

In another embodiment, the wireless communication could be replaced with a wired link. E.g., an electrical cable could extend from the interface 246 to the motor 240.

Still other examples exist as well. For example, channels 87, 87' of rails 80, 80' may include a rack gear, and wheels 158 of trolley 24 may comprise corresponding pinion gears. In such an embodiment, the trolley could move upwardly or downwardly incrementally or otherwise. This arrangement may be used in conjunction with actuator 26, actuator 26A, or another actuator configuration. Further, other implementations could be employed that permit the trolley to move upwardly toward the upper ends 84 of rails 80, 80' or to move downwardly toward the lower ends 86 of rails 80, 80'.

Figure 12:
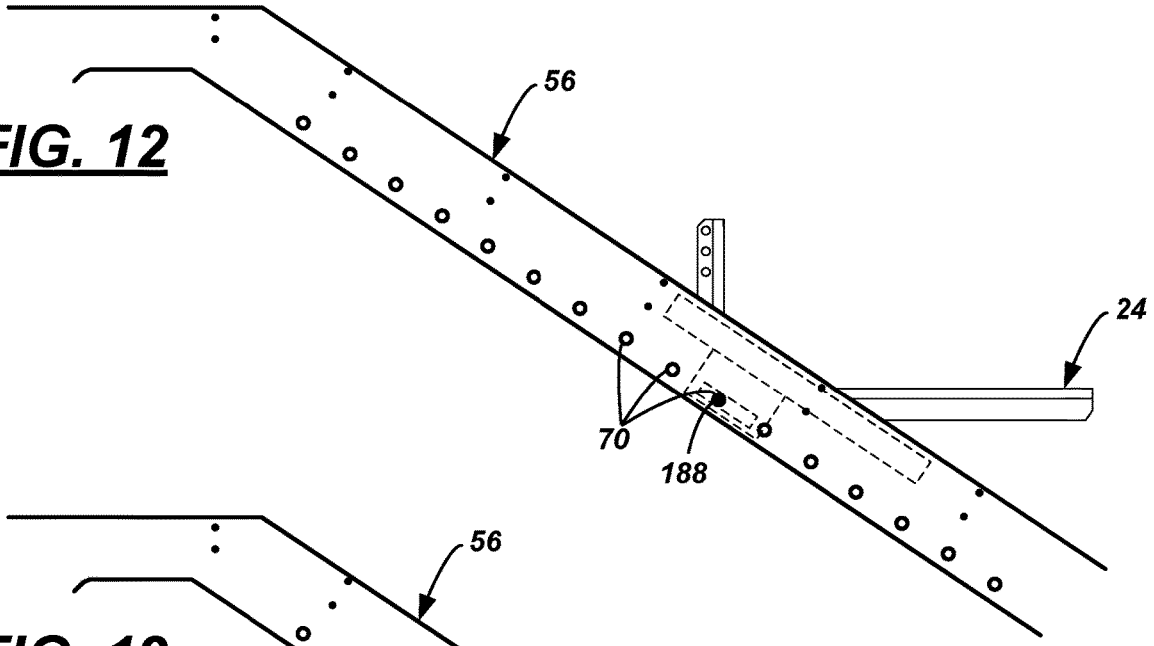
FIGS. 12-14 depict partial front views of the target stand shown in FIG. 1, wherein the trolley is shown at various positions—by way of example only, an initial position (FIG. 12), an intermediate position (FIG. 13), and a final position (FIG. 14).
Figure 13:
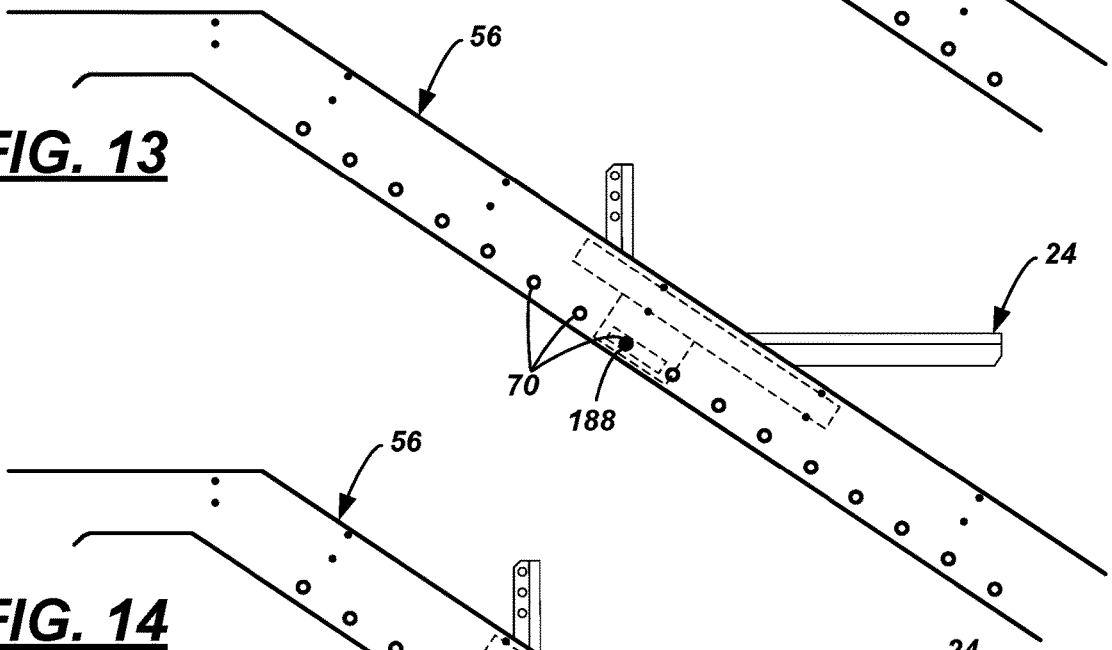
Figure 14:
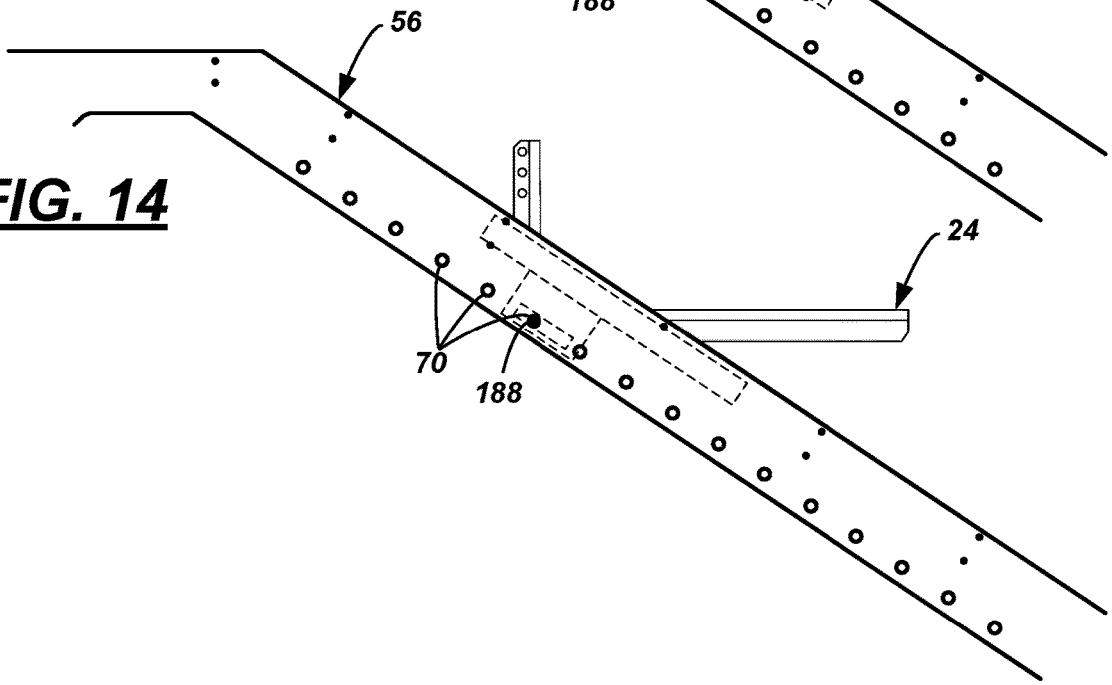

Each of FIGS. 12-14 depict a partial front view of the target stand 20, wherein trolley 24 is shown at various positions along inclined members 56', 56' (inclined member 56' and rails 80, 80' are hidden in these views). Hence collectively, FIGS. 12-14 depict trolley 24 incrementally moving in one direction (e.g., upwardly). Incremental (or incrementally) may refer to multiple movements on a fixed scale of movement—e.g., the fixed scale may be defined by the hole pattern and spacing of holes 70. Consequently and according to one embodiment, trolley 24 may move a multiple of these increments (1×, 2×, 3×, etc.). In FIGS. 12-14, trolley 24 is displaced 2× or has been moved in increments of two holes 70.

FIG. 12 illustrates trolley 24 in an example initial position, FIG. 13 illustrates trolley 24 in an example intermediate position, and FIG. 14 illustrates trolley 24 in an example final position. In each of FIGS. 12-14, unidirectional lock 188 is shown in different holes 70. These figures are used to explain an example use embodiment following a detailed description of an example target B, wherein it may be desirable to impact target B with precision and within a predetermined impact region.

Figure 15:
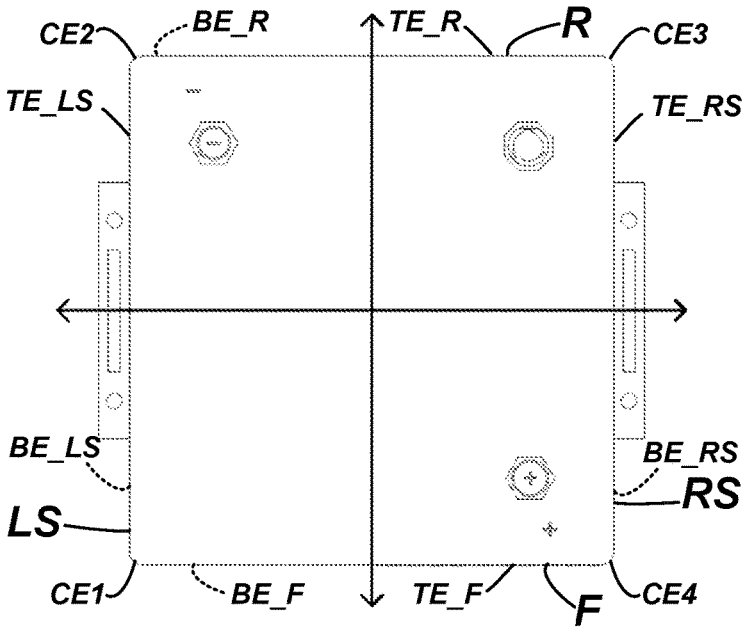
FIG. 15 illustrates a top view of an example target object under test (a battery), wherein directional lines depict projectile penetration related to destructive testing.

FIGS. 15-19 illustrate various aspects of one embodiment of target B. Here, target B is illustrated as a STANAG 4015 battery having a 6T form factor. As discussed above, MIL-PRF-32565 sets forth destructive testing of the STANAG 4015 battery using an example projectile P (the 7.62 mm API projectile). FIG. 15 illustrates a top view of target B, wherein directional lines illustrate firing projectiles through front face F, a rear face R, a left side face LS, and a right side face RS. Each face F, R, LS, RS is defined by an edge of target B—namely corner edges CE1, CE2, CE3, CE4, top edges TE_F, TE_R, TE_LS, TE_RS, and bottom edges BE_F, BE_R, BE_LS, BE_RS. In FIG. 15, dashed lead lines are used to indicate the bottom edges: BE_F, BE_R, BE_LS, BE_RS of target B.

According to an example, front face F of target B may be positioned co-planar with respect to plane-YZ (e.g., shown in FIGS. 1, 11). And according to at least one example, when trolley 24 is moved by actuator 26, front face F remains within plane-YZ. Similarly, regardless of which face of target B is the subject of live fire testing (e.g., face F, R, LS, RS), the respective face may be positioned to be within plane-YZ.

Figure 16:
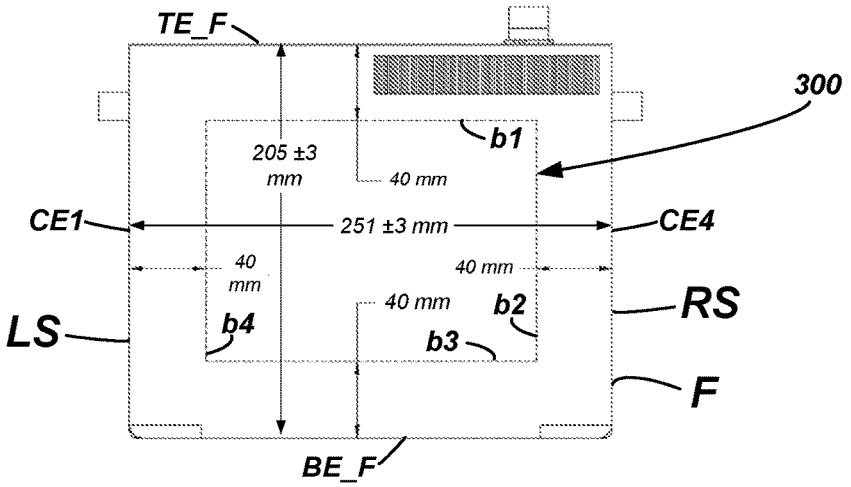
FIG. 16 is a front view of the battery shown in FIG. 15 further illustrating an impact region on a front face of the target.
Figure 17:
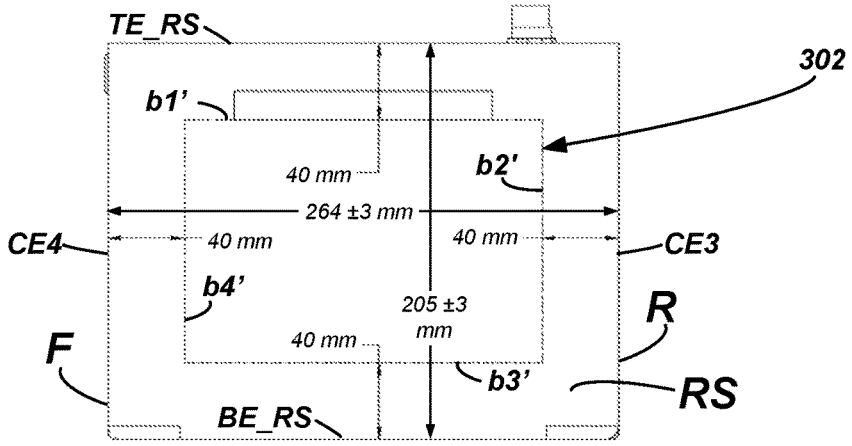
FIG. 17 is a side view of the battery shown in FIG. 15 further illustrating an impact region on a side face of the target.
Figure 18:
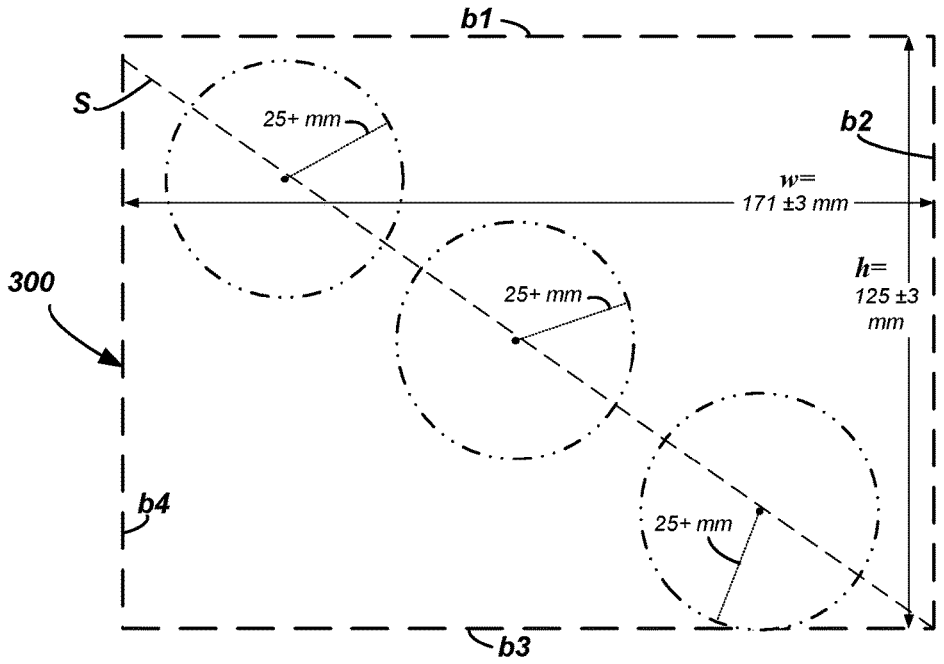
FIG. 18 depicts the impact region (on the front face) of the battery shown in FIG. 16, further illustrating impact spacing of three projectiles.
Figure 19:
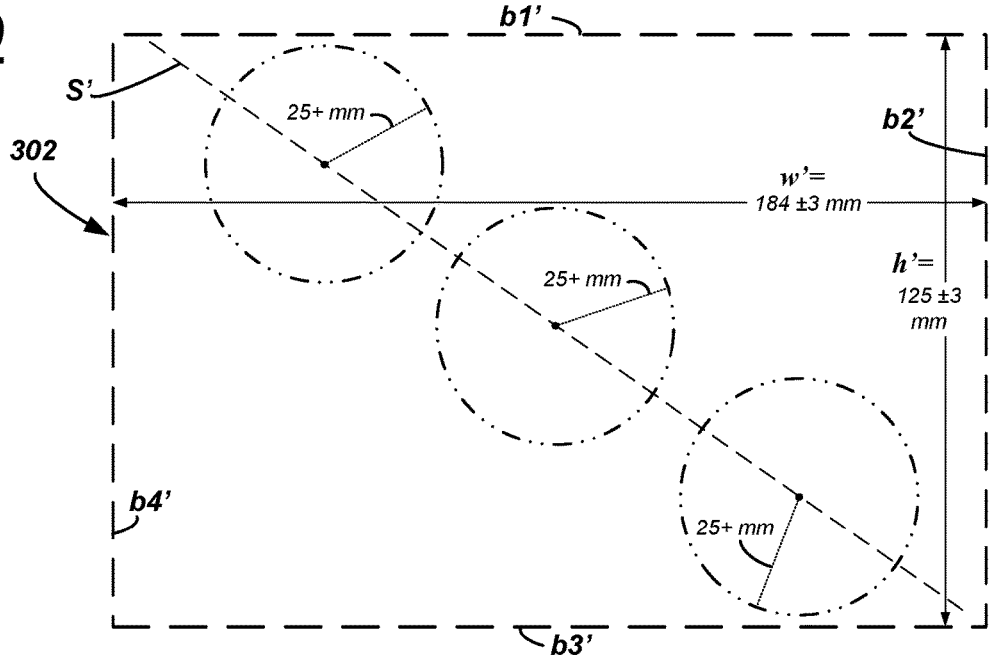
FIG. 19 depicts the impact region (of the side face) of the battery shown in FIG. 17, further illustrating impact spacing of three projectiles.

Each face F, R, LS, RS of the target B may have an impact region, wherein the impact region may be an area within which projectiles P are to strike the target B; a front impact region 300 is shown in FIGS. 16 and 18, and a right side impact region 302 is shown in FIGS. 17 and 19. It should be appreciated that a rear impact region may be similar to impact region 300, a left side impact region may be similar to impact region 302. According to an embodiment set forth in MIL-PRF-32565, impact region 300 may defined by an area measured 40 mm from each edge of the target B—e.g., for the front view shown in FIG. 16, 40 mm inwardly of each of top edge TE_F to a top boundary b1, bottom edge BE_F to a bottom boundary b3, corner edge CE1 to a left boundary b4, and corner edge CE4 to a right boundary b2. Dimensions of the STANAG 4015 battery are shown for illustrative purposes only. Impact region 302 may be defined similarly (e.g., see b1', b2', b3', b4' in FIGS. 17 and 19).

MIL-PRF-32565 requires (a) three projectiles P to impact within impact region 300; (b) that each of the impacts are to be at least 50 mm on center from one another; (c) that each projectile strike the impact region 300 at a 90° angle; and (d) that the first projectile strike the target B within 90 seconds of the third projectile. It will be appreciated that projectiles P are fired at target B from a distance—and while some degree of accuracy is attainable—perfection is typically not possible. For instance, in some examples it is desirable to perform live fire testing of 7.62 mm projectiles at a distance between 8 and 100 meters. Accordingly, the target stand 20 facilitates striking the impact region 300 (or 302). Using the target stand 20 which raises the trolley 24 and target B diagonally, a span S of the impact region 300 can be utilized without moving the projectile source 14 (i.e., without moving the weapon). Since span S is longer than the width (w) or height (h) of impact region 300, the space between projectiles can be increased thereby increasing the likelihood that three projectiles P can be fired at the target B and that all requirements of MIL-PRF-32565 can be met. Further, since the trolley 24 can be remotely moved (e.g., by a user of the projectile source 14 up-range), the 90 second requirement may be more easily achievable.

It will be appreciated that though MIL-PRF-32565 identifies an electric battery as the targeted object under test.

Other examples of target B also could be used instead—e.g., such as bulletproof glass, bulletproof vests, armor or armor plating, etc. Target stand 20 may be adapted to meet other military requirements regarding timing of projectile firing and projectile spacing. Further, it should be appreciated that while a few example targets have been listed; this list is not intended to be exhaustive, nor is the target stand 20 intended to be limited to military testing. E.g., commercial security, police, and other industries similarly may design and implement target stand 20 for testing of any suitable projectile testing.

Thus, there has been described a target stand for a range. The target stand includes a frame and trolley that is adapted to carry a target. The trolley comprises a base; the base comprises a proximal portion that is coupled to a pair of wheel assemblies and a cantilevered portion that protrudes away from the proximal portion. According to an example described above (and not intending to be limiting), the trolley may be actuated to move diagonally upwardly with respect to the frame so that multiple projectiles may be fired at the target from an up-range position and so that a relatively-small impact region may be struck in accordance with a predetermined spacing.

Embodiments of the present disclosure have been described above. It is to be understood, however, that the disclosed embodiments are merely examples and other embodiments can take various and alternative forms. Further, it is contemplated that one or more embodiments may be combined with one another—regardless of whether such various combinations of embodiments are explicitly illustrated in the figures or described in the written description.

The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments.

In addition, relative terms in the detailed description or in the claims such as "upper," "lower," "middle," "above," "over," "b el ow," "under," "front," "back," "forward," "rearward", "right," "left," and the like are not intended to be limiting; instead, such terms are used to illustrate, to enhance explanation, to explain relative positions of the elements, etc. Terms in the detailed description or in the claims such as "first," "second," "third," etc. are not intended to be limiting either; instead, such terms are used merely to differentiate elements from one another or the like.

Herein, the term "coupled" refers to either "coupled directly" or "coupled indirectly". For example, where a structure comprises X coupled to Y and Y is further coupled to Z, then X may be referred to as "coupled" to Z. Additionally, X may be referred to as "indirectly coupled" to Z and "directly coupled" to Y. Thus, where the detailed description or claims recite "coupled", this term means either "coupled directly" or "coupled indirectly". Alternatively, if the detailed description or claims mean coupled directly or coupled indirectly, it explicitly uses the terms "directly" or "indirectly".

The invention claimed is:

1. A target stand for carrying a target object under test for impact testing by a projectile from a projectile source, the target stand configured to be arranged relative to level ground and down range of the projectile source, the projectile source configured to fire the projectile along an x-axis, wherein the x-axis is parallel to the level ground and orthogonal to the target stand, a y-axis is parallel to the level ground and orthogonal to the x-axis, and a z-axis is orthogonal to the level ground, the x-axis, and the y-axis, and the target stand comprising:

a frame;

a first rail supported by the frame and having an upper end and a lower end, the first rail extending diagonally relative to the y-axis and the z-axis from the lower end of the first rail to the upper end of the first rail;

a second rail supported by the frame and having an upper end and a lower end, the second rail extending diagonally relative to the y-axis and the z-axis from the lower end of the second rail to the upper end of the second rail; and a trolley disposed between the first rail and the second rail, the trolley including a base, the base being a plate arranged parallel to the y-axis and orthogonal to the z-axis, the base having an upper surface orthogonal to the z-axis, a proximal portion, a cantilevered portion, and a free end, wherein the cantilevered portion of the base extends longitudinally in a direction of the y-axis away from the proximal portion of the base and toward the free end of the base, a first wheel assembly coupled to the proximal portion of the base and in contact with the first rail, and a second wheel assembly coupled to the proximal portion of the base and in contact with the second rail, wherein the first rail is spaced from the second rail relative to the x-axis, and wherein the trolley is movable between the respective lower ends of the first and second rails and the respective upper ends of the first and second rails via the first wheel assembly contacting the first rail and the second wheel assembly contacting the second rail such that in response to the trolley translating from a first position to a second position relative to the first and second rails, the trolley moves diagonally in a first direction relative to the y-axis and the z-axis, and wherein the upper surface of the base of the trolley at the cantilevered portion near the free end of the base is configured to carry the target object, and wherein in response to the trolley moving diagonally in the first direction, the base of the trolley remains parallel to both the y-axis and the level ground and the upper surface of the base remains orthogonal to the z-axis, and wherein the frame comprises a first inclined member and a second inclined member wherein the first rail is coupled to the first inclined member, the second rail is coupled to the second inclined member, and each of the first and second inclined members comprise a series of linearly spaced holes extending along at least a partial length thereof, and wherein the first wheel assembly comprises a wheel portion that comprises a carrier that supports a set of wheels and a stopper portion, and wherein the stopper portion comprises a flange portion that extends from a side of the carrier and a clip that is coupled to the flange portion, wherein the clip comprises a lock that is configured to move within one of the series of linearly spaced holes and retain a position of the trolley relative to the first and second rails.

2. The target stand of claim 1, the frame comprises a first inclined member and a second inclined member, wherein each of the first and second inclined members have a downward slope from a high end to a low end with respect to the y- and z-axes, wherein the first rail is coupled to the first inclined member such that the upper end of the first rail corresponds to the high end of the first inclined member and the lower end of the first rail corresponds to the low end of the first inclined member, wherein the second rail is coupled to the second inclined member such that the upper end of the second rail corresponds to the high end of the second inclined member and the lower end of the second rail corresponds to the low end of the second inclined member.

3. The target stand of claim 2, wherein each of the first and second rails comprise a channel, wherein a set of wheels of the first wheel assembly is positioned in the channel of the first rail, wherein a set of wheels of the second wheel assembly is positioned in the channel of the second rail.

4. The target stand of claim 3, wherein the first rail is coupled to an inboard face of the first inclined member, wherein the second rail is coupled to an inboard face of the second inclined member.

5. The target stand of claim 1, wherein a spacing of the holes is incremental.

6. The target stand of claim 1, wherein the clip is coupled to an outboard side of the flange portion, wherein the clip comprises a spring that biases the lock into one of the series of linearly spaced holes.

7. The target stand of claim 6, wherein the stopper portion further comprises a spacer coupled between the clip and the flange portion, wherein the spring comprises a first leg coupled to the spacer, a second leg coupled to the lock, and a U-shaped bend that is coupled to each of the first leg and the second leg.

8. The target stand of claim 7, wherein the lock comprises a ramped projection having a low edge and a high edge, wherein the low edge is oriented with respect to the second leg in order to permit the trolley to move diagonally upwardly along the first and second rails as the lock moves in and out of the linearly spaced holes, wherein the high edge is oriented with respect to the second leg in order to inhibit movement of the trolley diagonally downwardly along the first and second rails.

9. The target stand of claim 1, wherein the trolley further comprises an actuator bracket coupled near the proximal portion of the base, wherein the actuator bracket extends upwardly with respect to the and z-axis, wherein the carrier is coupled to the base and the actuator bracket.

10. The target stand of claim 1, wherein the second wheel assembly comprises a stopper portion.

11. The target stand of claim 1, wherein the lock is a unidirectional lock, wherein the unidirectional lock inhibits diagonal movement of the trolley in one direction, however, permits diagonal movement of the trolley in an opposite direction.

12. The target stand of claim 1, further comprising an actuator coupled to the frame and to the trolley, wherein, when the actuator is actuated, the trolley translates from the first position to the second position, moving diagonally in the first direction relative to the y- and z-axes.

13. The target stand of claim 12, wherein the actuator comprises a cable coupled to the trolley at a first end and a cable feed system.

14. The target stand of claim 13, wherein the cable feed system comprises a first pulley coupled to a first stanchion at a high end of the frame and a second pulley coupled to a second stanchion coupled to the frame and located below the first stanchion.

15. The target stand of claim 1, wherein the target object under test is a battery having a 6T form factor, and wherein the upper surface of the base of the trolley at the cantilevered portion near the free end of the base is configured to carry the battery having a 6T form factor.

* * * * *